US008023678B2

(12) United States Patent
Fischer

(10) Patent No.: US 8,023,678 B2
(45) Date of Patent: Sep. 20, 2011

(54) HEARING DEVICE WITH ON/OFF SWITCH AND ASSOCIATED METHOD

(75) Inventor: Eghart Fischer, Schwabach (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 748 days.

(21) Appl. No.: 12/214,138

(22) Filed: Jun. 17, 2008

(65) Prior Publication Data

US 2009/0003638 A1 Jan. 1, 2009

(30) Foreign Application Priority Data

Jun. 26, 2007 (DE) ..... 10 2007 029 375

(51) Int. Cl.
*H04R 25/02* (2006.01)

(52) U.S. Cl. ..... 381/330; 381/324

(58) Field of Classification Search ..... 381/330, 381/324

See application file for complete search history.

(56) References Cited

U.S. PATENT DOCUMENTS

| | | | | |
|---|---|---|---|---|
| 2,910,679 | A * | 10/1959 | Baldwin | 340/575 |
| 3,975,599 | A * | 8/1976 | Johanson | 381/313 |
| 7,760,898 | B2 * | 7/2010 | Howell et al. | 381/327 |
| 2004/0042629 | A1 | 3/2004 | Mellone et al. | |
| 2006/0171550 | A1 * | 8/2006 | Bryant et al. | 381/330 |
| 2010/0086157 | A1 * | 4/2010 | Feeley et al. | 381/324 |

FOREIGN PATENT DOCUMENTS

| | | | |
|---|---|---|---|
| DE | 31 09 049 | C2 | 9/1982 |
| DE | 198 52 758 | C2 | 5/2001 |
| EP | 1496530 | A2 | 1/2005 |

* cited by examiner

*Primary Examiner* — Allan R Wilson

(57) ABSTRACT

A hearing device and an associated method are provided. The hearing device includes a behind-the-ear part and an in-the-ear part that are connected to one another by a connecting element. The behind-the-ear part has a switching element arranged to be functionally connected to the connecting element such that at least two switching positions of the switching element can be engaged by a movement of the connecting element.

15 Claims, 1 Drawing Sheet

HEARING DEVICE WITH ON/OFF SWITCH AND ASSOCIATED METHOD

CROSS REFERENCE TO RELATED APPLICATIONS

This application claims priority of German application No. 10 2007 029 375.7 DE filed Jun. 26, 2007, which is incorporated by reference herein in its entirety.

FIELD OF INVENTION

The invention relates to a hearing device having a behind-the-ear part and an in-the-ear part, and to an associated method.

BACKGROUND OF INVENTION

Hearing devices with a behind-the-ear part and an in-the-ear part are to become smaller and smaller, are to be watertight and are additionally to have a pleasant outer appearance. Furthermore the switching positions "on" and "off" of an on/off switch on the hearing device must also be easily distinguishable for older people so that known push-button switches are not considered here. Thus the integration of an on/off switch in a small hearing device is challenging from a design perspective.

A hearing device having a relatively large on/off switch in the form of a rotary switch attached to the behind-the-ear part with a switching lug is known from the patent specification DE 198 52 758 C2.

SUMMARY OF INVENTION

The object of the invention is to specify a further hearing device having an on/off switch that can be visibly switched on and off even in very small hearing devices.

In accordance with the invention the object set is achieved in the apparatus of the type mentioned above and in the associated method by means of the features listed in the independent claims, whereby an on/off switch is switchable by means of a connecting element between the behind-the-ear part and the in-the-ear part of a hearing device.

According to the invention the hearing device comprises a behind-the-ear part and an in-the-ear part that are connected to one another by means of a connecting element. A switching element is arranged between the behind-the-ear part and the connecting element, which is functionally connected to the connecting element such that at least two switching positions of the switching element can be adjusted by moving the connecting element.

Furthermore a method is specified according to the invention for switching on and off a hearing device that comprises a behind-the-ear part and an in-the-ear part, which are connected to one another by means of a connecting element. In this method at least two switching positions are engaged by a movement of the connecting element or of the behind-the-ear part.

The subject matter of the invention has the advantage that an on/off switch, having a switching position that is easily distinguishable and easily operated, can be integrated even into very small hearing devices.

The movement of the connecting element is preferably a rotary motion, in particular a rotation through an angle of rotation of ninety degrees.

The switching element can have two switching positions, with the hearing device being switched on in a first switching position and switched off in a second switching position.

In this way the hearing device is switched on when worn by a hearing device wearer and can easily be switched off after removal.

The switching positions of the switching element of the hearing device can be made to engage noticeably.

In this way the switching positions are easily distinguishable for a hearing device wearer.

The switching element is preferably composed of a rotary switch, comprising a rotatable female connector arranged on the behind-the-ear part and a plug part that is rigidly connected to the connecting element and that can be plugged into the female connector, with the plug part that is plugged into the female connector being rotatable together with the female connector.

In this way the connecting element together with the in-the-ear part can easily be separated from the behind-the-ear part.

An electrical connection between the rotatable female connector and the behind-the-ear part is preferably achieved by means of sliding contacts and slip rings.

In this way electrical cables in the connecting element are not damaged despite frequent rotary motions.

The connecting element can comprise a sound-conducting tube and/or electrical cables. It can be rigid or can be composed of a memory material that ensures a stable, predefinable endform of the connecting element.

Further advantageous embodiments are specified in the dependent claims.

BRIEF DESCRIPTION OF THE DRAWINGS

Further specific features of the invention will be apparent from the following explanations of an exemplary embodiment with reference to schematic drawings, in which.

DETAILED DESCRIPTION OF INVENTION

Figure 1:
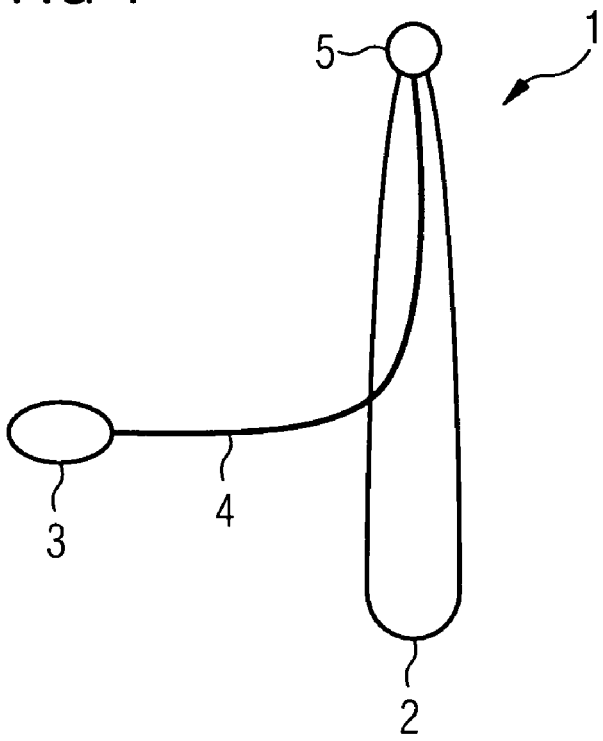
FIG. 1 shows a view of a switched-off hearing device.
Figure 2:
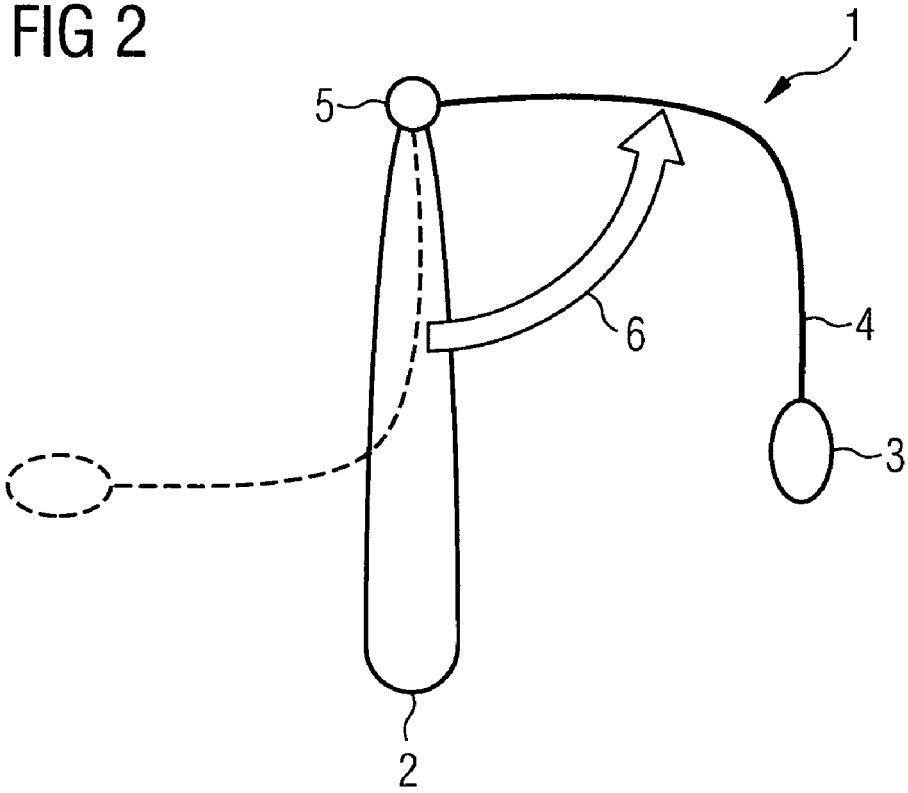
FIG. 2 shows a view of a switched-on hearing device.

FIGS. 1 and 2 show a front view of a hearing device. The hearing device comprises a behind-the-ear part 2, an in-the-ear part 3 and a connecting element 4 that connects these two parts 2, 3 to one another. The connecting element 4 is rotatably connected to the behind-the-ear part 3 by means of a switching element 5. The connecting element 4 is generally rigid and serves to conduct electrical signals or sound waves from the behind-the-ear part 2 to a receiver of the in-the-ear part 3. It also serves to secure the hearing device 1 on the concha of the hearing device wearer. However it also facilitates insertion of the in-the-ear part 3 into the auditory canal, since the in-the-ear part 3 can easily be guided by the rigid connecting element 4.

The connecting element 4 has a wire for example as its core which, together with an electrical connecting line, is surrounded by a plastic. The connecting element 4 can be deformed when warm for example. In another embodiment the connecting element 4 is a tube that can be deformed when warm, into which sound waves are conducted from the behind-the-ear part 2 to the earmold piece of the in-the-ear part 3.

The shape of the in-the-ear part 3 is advantageously precisely matched to the auditory canal of the hearing device wearer. The behind-the-ear part 2 should also fit precisely with the space behind the ear. Furthermore the connecting element 4 can match the anatomy of the concha of the hearing device wearer in length and in shape.

The switching element 5, through which the connecting element 4 is connected to the behind-the-ear part 2, is for example a rotary switch 5 with two switching positions "on" and "off". Through rotation 6 of the connecting element 4 for example by the hearing device wearer it is possible to switch between these two switching positions. Preferably the two switching positions are distinguished by the connecting element 4 having an angle of rotation of 90 degrees, and the two switching positions preferably also engage noticeably.

The connecting element 4 is preferably designed such that it can be plugged into the switching element 5.

If the connecting element 4 also comprises electrical cables, these must be contacted by the rotary switch 5. In order to avoid unnecessary and fault-prone bending of the electrical cables this is preferably achieved by means of sliding contacts that are located in a movable part of the rotary switch 5 and that maintain contact with slip rings in a fixed part of the rotary switch 5. Through plugging of the connecting element 4 into the rotary switch 5, the electrical cables make contact with the sliding contacts.

If the connecting element 4 is a tube for sound transmission, then naturally no sliding contacts or slip rings will be necessary. For example, however, a tube arranged in the behind-the-ear part 2 and the tube of the connecting element 4 are rotatably connected with a precise fit in order to enable frictionless sound transmission.

FIG. 1 shows the hearing device 1 in the switched-on state. The connecting element 4 is in a position in which the hearing device is used/worn by the hearing device wearer. The rotary switch 5 is set to the "on" position.

FIG. 2 shows the hearing device 1 in the removed and switched-off state. The connecting element 4 is in a position that is twisted by means of a rotation 6 e.g. through 90 degrees compared to the switched-on position. The rotary switch 5 is set to the "off" position.

The invention claimed is:

1. A hearing device, comprising:

a behind-the-ear part;

an in-the-ear part;

a connecting element that connects the behind-the-ear part with the in-the-ear part; and a switching element functionally connected to the connecting element and arranged on the behind-the-ear part such that a first switching position of the switching element and a second switching position of the switching element are achieved by a movement of the connecting element relative to the behind-the-ear part.

2. The hearing device as claimed in claim 1, wherein the movement of the connecting element is a rotary motion.

3. The hearing device as claimed in claim 2, wherein the switching positions are distinguishable by an angle of rotation of ninety degrees that determines the switching positions.

4. The hearing device as claimed in claim 1, wherein the hearing device is switched on in the first switching position and switched off in the second switching position.

5. The hearing device as claimed in claim 1, wherein the switching positions of the switching element noticeably engage.

6. The hearing device as claimed in claim 1, wherein the switching element includes a rotary switch that comprises a rotatable female connector arranged on the behind-the-ear part and a plug part that is rigidly connected to the connecting element and that can be plugged into the female connector, and wherein the plug part that is plugged into the female connector being rotatable together with the female connector.

7. The hearing device as claimed in claim 6, wherein an electrical connection between the rotatable female connector and the behind-the-ear part is achieved by sliding contacts and slip rings.

8. The hearing device as claimed in claim 1, wherein the connecting element comprises a sound-conducting tube, electrical cables or combination thereof.

9. The hearing device as claimed in claim 1, wherein the connecting element is rigid or is composed of a memory material that ensures a stable, predefinable endform of the connecting element.

10. A method for switching on and off a hearing device, comprising:

connecting a behind-the-ear part to an in-the-ear part by a connecting element; and providing a switching element functionally connected to the connecting element and arranged on the behind-the-ear part such that a first switching position of the switching element and a second switching position of the switching element are achieved by a movement of the connecting element relative to the behind-the-ear part.

11. The method as claimed in claim 10, wherein the movement of the connecting element is a rotary motion.

12. The method as claimed in claim 11, wherein the switching positions are distinguishable by an angle of rotation of ninety degrees that determines the switching positions.

13. The method as claimed in claim 10, wherein the hearing device is switched on in the first switching position and switched off in the second switching position.

14. The method as claimed in claim 10, wherein the switching positions of the switching element noticeably engage.

15. The method as claimed in claim 10, wherein the switching element includes a rotary switch that comprises a rotatable female connector arranged on the behind-the-ear part and a plug part that is rigidly connected to the connecting element and that can be plugged into the female connector, and wherein the plug part that is plugged into the female connector being rotatable together with the female connector.

* * * * *